US009149107B2

(12) United States Patent
Chan

(10) Patent No.: US 9,149,107 B2
(45) Date of Patent: Oct. 6, 2015

(54) MULTIPLE COSMETICS PRESS-TO-DISPENSE COSMETICIZING DEVICE

(71) Applicant: Lin-Lang Chan, Taichung (TW)

(72) Inventor: Lin-Lang Chan, Taichung (TW)

( * ) Notice: Subject to any disclaimer, the term of this patent is extended or adjusted under 35 U.S.C. 154(b) by 0 days.

(21) Appl. No.: 14/183,457

(22) Filed: Feb. 18, 2014

(65) Prior Publication Data

US 2015/0230587 A1 Aug. 20, 2015

(51) Int. Cl.
*A45D 40/26* (2006.01)
*A45D 40/20* (2006.01)

(52) U.S. Cl.
CPC ..... *A45D 40/262* (2013.01); *A45D 40/205* (2013.01); *A45D 2040/207* (2013.01)

(58) Field of Classification Search
CPC combination set(s) only.
See application file for complete search history.

(56) References Cited

U.S. PATENT DOCUMENTS 8,845,221 B2 * 9/2014 Fukumoto ..... 401/172
2002/0070247 A1 * 6/2002 Kageyama et al. ..... 222/386

* cited by examiner

*Primary Examiner* — David Walczak
(74) *Attorney, Agent, or Firm* — Leong C. Lei

(57) ABSTRACT

A cosmeticizing device that allows for loading of various cosmetic liquids for enabling non-interrupted supply of the cosmetic liquids through hand pressing. A cosmetic container body has an end forming a tubular opening receiving a valve seat for fixing a cosmeticizing component and an inner tubular bottom to which a valve disk is movably mounted for closing the bottom of the container. With a plunger bar that is rotatably coupled to the valve disk being pressed down, the valve disk is caused to slidably squeeze out the material for dispensing the liquid material to the cosmeticizing component mounted to the top end of the container body. A closure cap has an opening having an inner circumference forming a securing face and a bottom in which a scraping member is received and mounted. The cap has an interior space for receiving a cosmetic liquid.

9 Claims, 6 Drawing Sheets

MULTIPLE COSMETICS PRESS-TO-DISPENSE COSMETICIZING DEVICE

TECHNICAL FIELD OF THE INVENTION

The present invention generally relates to a multiple cosmetics press-to-dispense cosmeticizing device, and more particularly to a novel design of an improved cosmeticizing device that features easy and practical makeup and secured storage, enables loading of multiple cosmetic liquids, and allows for easy dispense of the cosmetic liquids through simple pressing operations for successive makeup operations.

DESCRIPTION OF THE PRIOR ART

To make up is considered a civil behavior for modern people and is also essentials for people loving to make and keep themselves beautiful. According to different cosmeticizing devices available, it often needs a container in which a cosmetic liquid is filled. A makeup tool is used with such a container to perform a makeup operation. Taking a lash makeup brush that is generally applied to lash makeup operations as an example, Taiwan Utility Model M361262 discloses a rotatable lash brush structure that comprises a tubular storage container that is provided for containing and storing a cosmetic liquid and has a top opening closable by a cap, the cap having an interior space in a center thereof where a plastic-molded smooth and straight stick like brush rod is mounted and projects outward and an outward-projecting distal end of the rod comprises a brush assembly mounted thereto and having brushing hairs attached thereto for lash makeup, which collectively form a complete lash brush structure. To store the entire lash brush, direct insertion is made into the interior of the container to contact and receive the liquid to attach thereto for next uses. Used in combination with a scraping blade arranged in the tube opening, the brush hairs may have excessive liquid attached thereto scraped off, so that an effect of safe lash makeup operation can be achieved with such brush hairs. However, the design and storage of cosmeticizing devices of this kind only allows for access and use of a single cosmetic liquid. On the other hand, when it is desired to carry out such a makeup operation that requires repeated attaching of the liquids or that requires uses of different colors of makeup, an additional cosmeticizing device must be purchased and provided, otherwise such uses cannot be achieved. Independent packages are needed for these cosmeticizing devices and this causes inconvenience of carrying. Further, in doing makeup, each time when the attached liquid is being used up, the cosmeticizing device, such as the lash brush and a lip tool, must be inserted into the container for liquid attachment. It is generally practically inconvenient. It is still room for improvement of the known cosmeticizing devices and package structures of the containers thereof to enable efficient and non-stop performance of a makeup operation, thereby making makeup operations easy and simple, in order to truly suit the needs of cosmeticizing.

SUMMARY OF THE INVENTION

The present inventor is a professional manufacturer of cosmeticizing devices, who is well aware of the drawbacks of inconvenience of doing makeup caused by the conventional cosmeticizing tools and, based on the years' experience of development and manufacture, provides a multiple cosmetics press-to-dispense cosmeticizing device for the purposes to suit the needs for cosmeticizing operations for or with eyes, lashes, and lip colorants, wherein a container body to which a cosmeticizing component is mounted is made in a U-shaped tubular configuration having an end forming an opening in which a valve disk is mounted for being depressed to dispense the liquid material so that the cosmetic liquid material can be timely supplied through pressing. The cosmeticizing component is closed by a cap, which has an end forming another liquid material filling space so as to enclose the cosmeticizing component when closed, whereby the cosmeticizing device is allowed to store multiple different cosmetic liquids, making it convenient for makeup operations to dispense the material through pressing, effectively improving the inconvenience of attaching the cosmetic liquid material and incapable of continuous use in a makeup operation of the conventional cosmeticizing devices.

The primary object of the present invention is that a cosmeticizing device has an assembly container having a bottom that is configured in a press-to-dispense arrangement, which, in combination with another containment and storage device formed by a cap, enables loading of cosmetic liquids therein to allow the cosmeticizing device to attach a proper amount of the cosmetic liquid before a makeup operation is started. During the makeup, a pressing structure provided at the bottom of the container body allows for pressing and controlling a valve disk to slide and squeeze the material to dispense, providing continuous supply of the material during the makeup, making it convenience for continuous use for the makeup, achieving a practical advantage of convenient attaching of the cosmetic material.

Another object of the present invention is that the internal recessed storage compartment of the cap and the container body can be loaded with separate cosmetic liquids so that in doing makeup, there is no need to change the cosmeticizing device for achieving multiple continuous makeup operations with various cosmetic liquids thereby achieving the purposes of convenience and safety of makeup operations.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
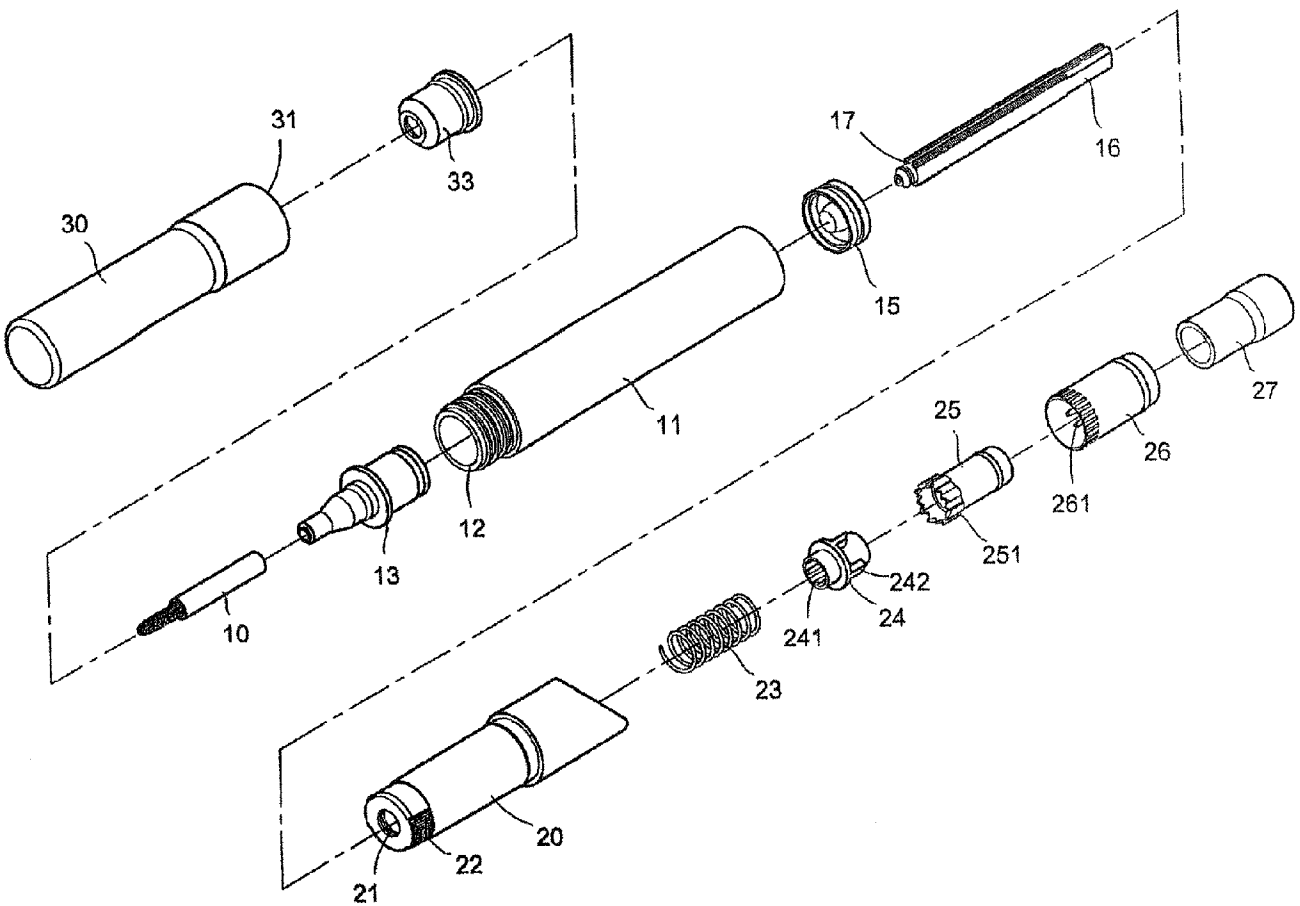
FIG. 1 is an exploded view of a cosmeticizing device according to the present invention.
Figure 2:
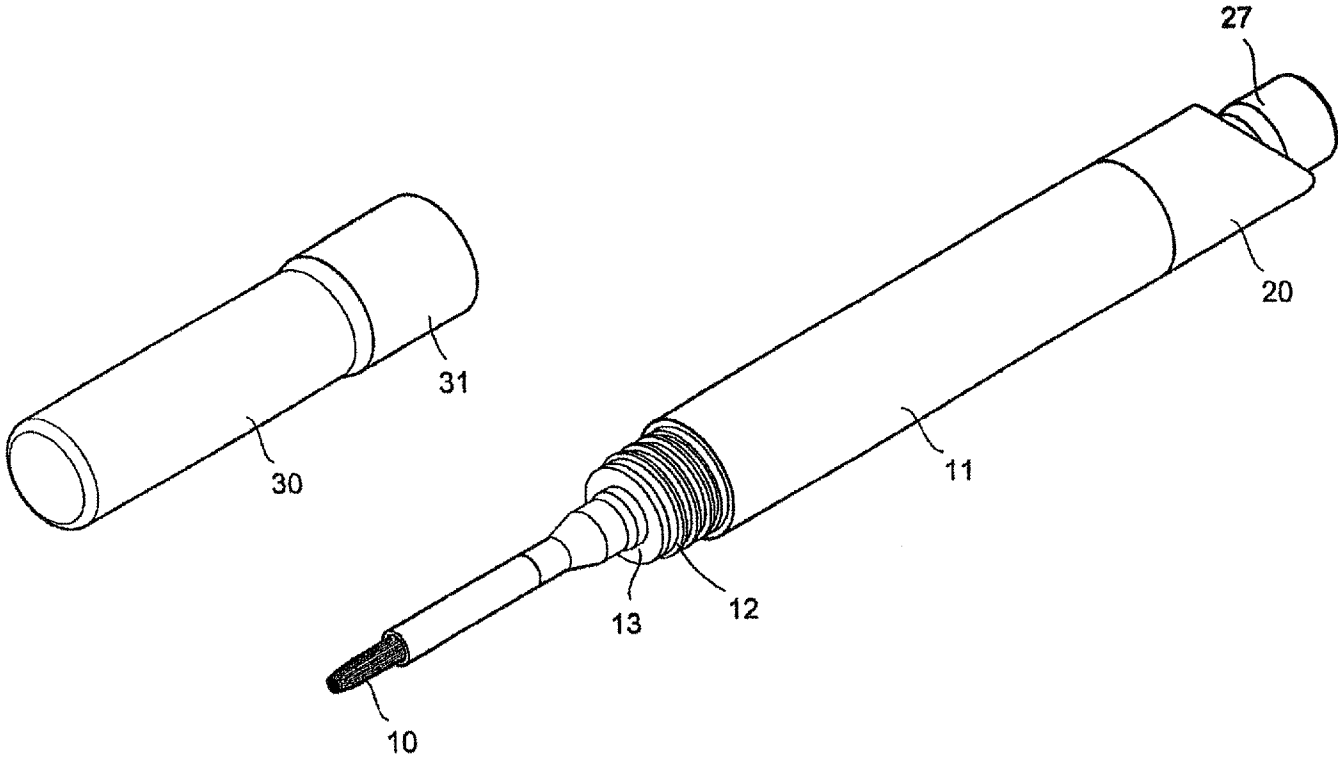
FIG. 2 is a perspective view showing the cosmeticizing device according to the present invention in an opened condition.
Figure 3:
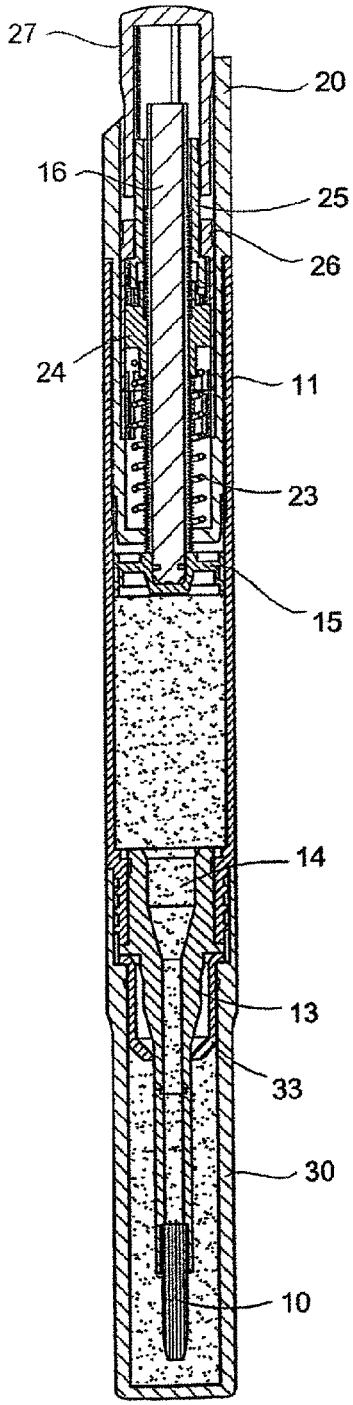
FIG. 3 is a cross-sectional view showing the cosmeticizing device according to the present invention in a stowed condition.
Figure 4:
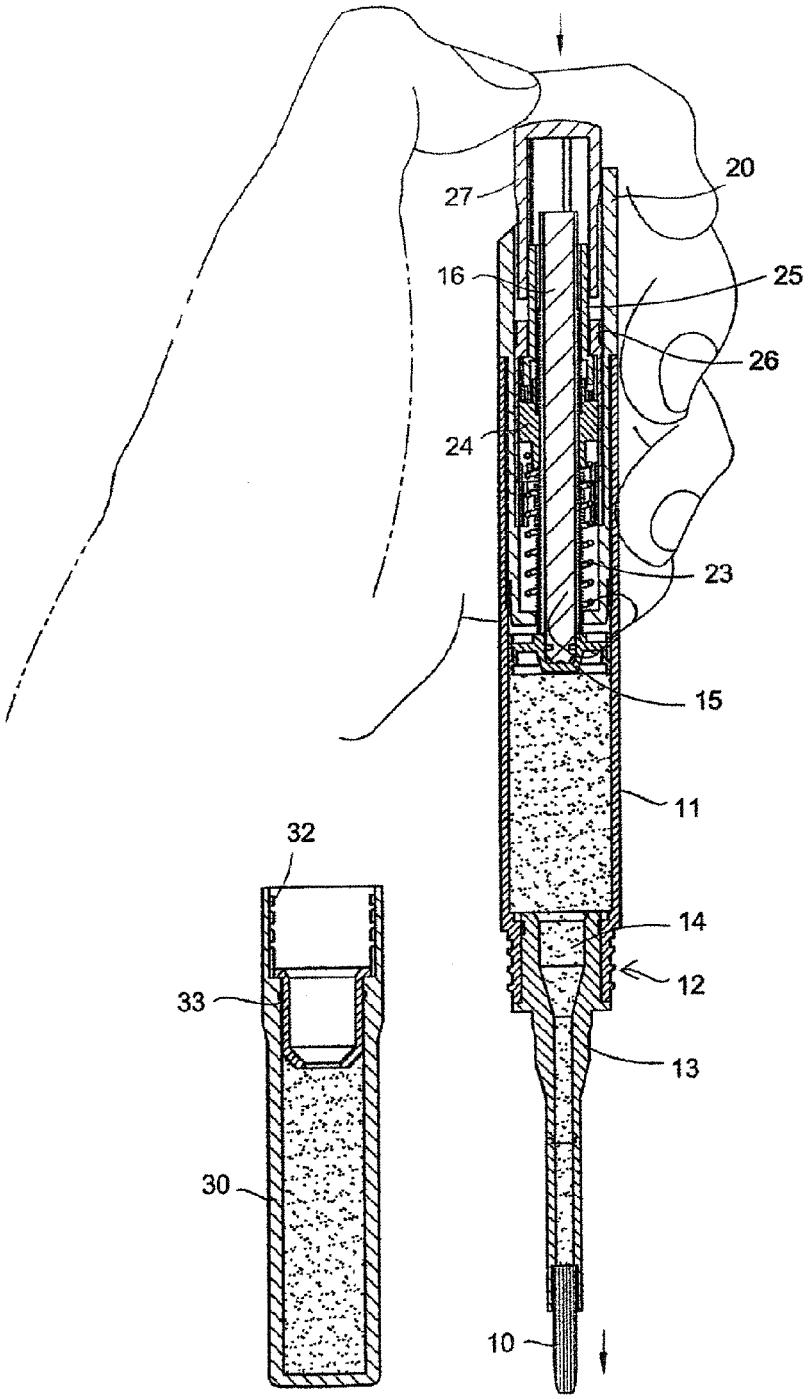
FIG. 4 is a cross-sectional view illustrating replenishment through press-to-dispense material of the cosmeticizing device of the present invention.
Figure 5:
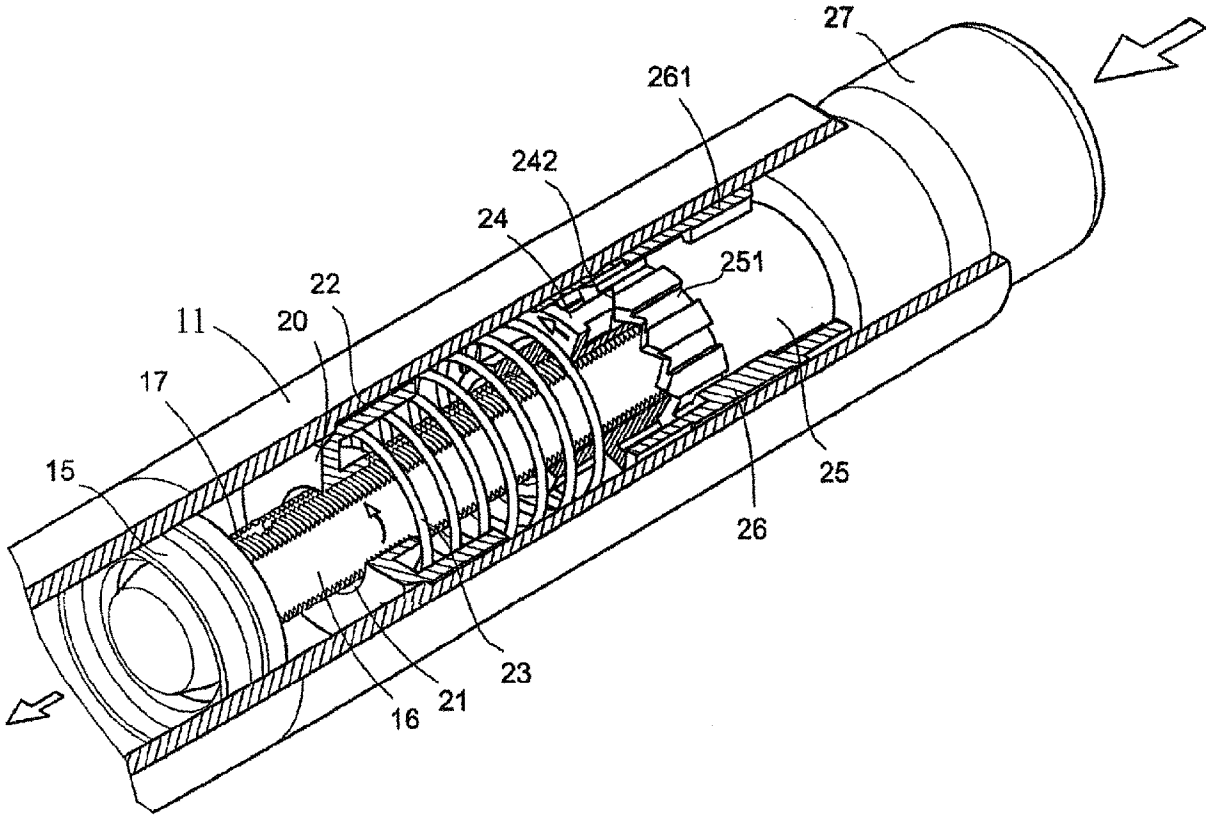
FIG. 5 is a perspective view, partially broken, illustrating a driving arrangement actuated through manual pressing according to the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

The present invention provides a multiple cosmetics press-to-dispense cosmeticizing device, which is configured so as to make the structure thereof an improved practical design that features secured storage and enables replenishment of cosmetic liquid to be performed through simple controlled press for a continuous makeup operation. The improved structure of the present invention is illustrated in FIGS. 1-5, in which a cosmeticizing component (10) for carrying out a makeup operation has a structure that is illustrated in the form of a structure of a lip brush as an illustration example herein, of which the outside appearance as a container is similar to a known one, comprising a hollow tubular container (11), serving as a main body for a stowed assembly, having an interior space for receiving a cosmetic liquid to fill therein to allow the cosmetic liquid to be retrieved through attachment for use in a makeup operation and an end forming a tubular opening (12) having a coupling threaded surface and receiving a retention valve seat (13) that retains the cosmeticizing component (10) to insert to a center thereof. The valve has a body that forms therein a channel (14) for passing the liquid so as to control of the supply of the liquid to the cosmeticizing component (10) mounted externally thereto. The container (11) has an opposite, bottom end into which a valve disk (15) is inserted to form closure of liquid storage bottom of the container (11). The valve disk (15) has a top that is positioned close to a lower end of a bottom tube seat (20). A plunger bar (16) has an end extending through and screwed in a threaded hole (21) formed in a center of the lower end of the bottom tube seat (20) to directly and rotatably coupled to a center of the valve disk (15) for connection and assembly. The plunger bar (16) has a circumferential surface that can be of a form of a circular bar or a form having opposite faces that are planar and parallel. However, the bar surface is recessed so as to form a positioning groove (17) or a plurality of opposite grooves. The bottom tube seat (20) has an end ring surface forming a rough pattern surface (22) that is inserted into and fixed at a fixed position inside the container body (11) to provide an inserted and fixed assembly for forming a completely enclosed filling space inside the container body (11), whereby with the fixation and assembly of the bottom tube seat (20), the plunger bar (16) is allowed for rotation through screwing to proceed with an operation of inward pushing and displacement of the valve disk (15) into the interior of the container body (11) by which a controlled operation of squeezing the filled cosmetic liquid for dispensing can be achieved. The control of the rotation of the plunger bar (16) is realized with an elastic member (23) and a rotary member (24) that are sequentially loaded in a tubular interior space of the bottom tube seat (20) in a mutually stacked and contacting manner. The rotary member (24) has a central hole having a surface on which straight ribs (241) that are parallel to an axial direction for mutually-fit engagement with the positioning groove (17) formed on the bar surface of the plunger bar (16) for purposes of guiding, so that with the mutually-fit engagement, the rotary member (24) is allowed to slide in the axial direction for position returning as being acted on by the spring force, allowing the plunger bar (16) and the rotary member (24) to achieve a coupled condition for transmission of controlled rotation. The rotary member (24) has a bottom flange on which a plurality of circumferentially-arranged projecting faces (242), which are engageable with, for the purposes of controlled transmission, ratchet-tooth faces of a bottom-located ratchet bar (25) in an alternately arranged and slightly-shifted manner. The rotary member (24) and the ratchet bar (25) are sequentially inserted into a socket sleeve (26) that is provided for angularly positioning purposes. The socket sleeve (26) has an inner circumferential surface on which positioning ribs (261) are formed to allow for mutual fitting with rib grooves (251) formed on an outer circumference of the ratchet bar (25) so that the ratchet bar (25) is only allowed to take axial sliding and also a bottom end of the ratchet bar (25) is projecting and inserted into a press control member (27) that is located outermost so as to allow the press control member (27) to be pressed down for driving the socket sleeve (26) to slide toward the container body (11) and to make the ratchet bar (25) undergo similar axial displacement. Through the alternating engagement arrangement between the ratchet-tooth faces of the ratchet bar (25) and the ratchet-tooth faces (242) of the rotary member (24), the rotary member (24) that is so depressed can rotate and slide in a fixed direction when being guided by the inclined faces of the ratchet teeth and simultaneously causes the plunger bar (16) to rotate in the same direction thereby driving the valve disk (15) to push and compress inwardly in the axial direction, forcing the internally received cosmetic liquid to squeeze out to the cosmeticizing component (10) through the dispense channel (14) of the valve seat (13) thereby achieving the purposes of controlled supply of the liquid for continuous makeup operations.

Further, a cap (30) that is used to receive, cover, and enclose the cosmeticizing component (10) after a makeup operation, is designed as a U-shaped tube having a tube opening (31) that has an inner circumference formed as a securing face (32) engageable with threaded surface of the container body (11) to couple therewith and also forming a locking bottom section that is arranged in a step-like configuration to allow for directly mounting and positioning a scraping member (33), which has a conically-reduced material-scraping opening rim, on the step, whereby the U-shaped interior bottom space of the cap (30) forms another storage space for receiving a liquid to fill therein, serving as a containing space for a cosmetic liquid, allowing storage of the cosmeticizing component (10), after the use thereof, to be done by inverting the container body (11) and directly fitting the cosmeticizing component (10) into the interior of the cap (30). This, together with a screwing and securing operation, allows the cosmeticizing component (10) to be securely and soundly stored through insertion, forming a novel structure of a cosmeticizing device that provides loading and storage of two liquids.

Figure 6:
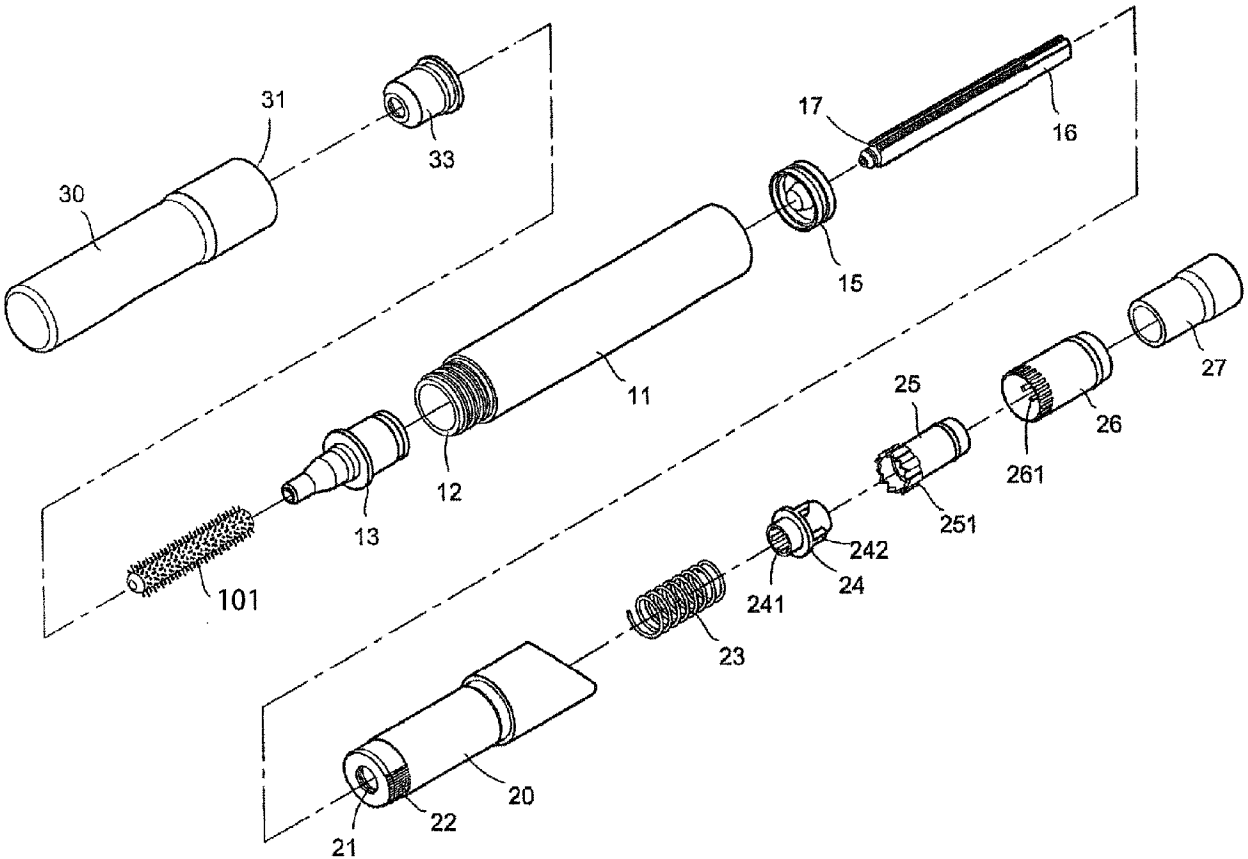
FIG. 6 is an exploded view showing another cosmeticizing device according to the present invention.

The improved features of the multiple material and storable cosmeticizing device are that in the process of a cosmeticizing operation, attaching of a cosmetic liquid and continuous and quantitative supply of the cosmetic liquid can be achieved to ensure smoothness and hygiene of a cosmeticizing operation so that a practical advantage of easy and time-efficient operation of makeup without relying on special cosmeticizing skills. Further, for the purposes of selecting and assembling an actual cosmeticizing component (10), the present invention is applicable to assembling various types of cosmeticizing tools, such as lip brush, liquid lip-stick brush, lash brush, eyeliner, or various cosmetic pencils. In the embodiment illustrated in FIG. 6, assembling with a regular lash brush is illustrated as an example. Through an easy operation of pressing to dispense material in a stable quantitative manner according to the present invention, in a process of being used for cosmeticizing purposes, the cosmeticizing component (10), when rotated out of the opening of the cap (30), allows excessive liquid to be scraped off by the internally mounted scraping member (33) and is then used for doing makeup. Similar to the operations of the conventional cosmetic package container, in the process of doing makeup, when the makeup coloring material attached to the cosmeticizing component (10) runs up or short, through pressing the press control member (27) at the end of the container body (11), the internally arranged ratchet bar (25) is driven to move forward in the axial direction and based on the guidance and driving in an inclined direction achieved with the ratchet-tooth faces (242), the rotary member (24) is caused to rotated to have the plunger bar (16), due to being coupled to and driven by the rotary member (24) and being controlled by the threaded hole (21) at the end of the bottom tube seat (20) for rotation and positioning, slide axially into the interior of the container body (11) to push the valve disk (15) to move inwardly, achieving an operation of quantitative squeezing and dispensing, allowing the cosmetic liquid loaded in the interior to be squeezed out in a quantitative manner and passing through the communication channel (14) to reach the cosmeticizing component (10) for being used in a continuous manner for makeup, thereby achieving a convenient makeup operation with easy supply of material. In doing makeup, automatic replenishment of cosmetic material in a quantitative manner can be achieved according to the need for makeup thereby ensuring convenience of continuous use for makeup.

For assembling of various types of cosmeticizing component (10) mentioned in the present invention, through the combination arrangement of the cap (30) coupled to and assembled with the container body (10), through the secured closure and coupling of the cap (30), and the scraping member (33) mounted to an inner circumference thereof adjacent to the opening, a storage space for loading is directly formed in the interior of the cap (30) for receiving a cosmetic liquid to fill therein, allowing for easy storage and insertion of the cosmeticizing component (10) and also simultaneous attaching of the material. To use for makeup, in rotating to release from the container body (11), through easily scraping off the excessive material by the scraping member (33), safe use of makeup can be realized. When it needs to have the cosmetic liquid material to be attached thereto again in doing a makeup operation, through pressing and driving make with the press control member (27) at an end of the container body (11), the closure valve disk (15) at the bottom of the container is driven to slide in a direction to push and squeeze the material toward the outlet opening. Based on the stepwise quantitative rotation control realized between the plunger bar (16) and the ratchet teeth, a quantitative dispense of the material can be achieved to provide, in doing makeup, automatic replenishment of the cosmetic liquid, making the cosmeticizing operation easy and better suiting the needs for hygiene and safety.

The arrangement of dual liquid material storage compartment according to the present invention provides, in the structure of a single cosmeticizing device for containing and assembling, the capability of loading or filling of different cosmetic liquid materials or different color liquid materials, achieving convenience and safety of cosmeticizing operation for using multiple colors for special makeups. The convenience of use and easy makeup operation, through multiple switching and selection, for continuous operation of makeup achieved with the present invention indeed makes the cosmetic container and the structure of the cosmeticizing device of the present invention a novel improved design.

In summary, the present invention provides a multiple cosmetics press-to-dispense cosmeticizing device, which comprises a container body and a closure cap that can be separately loaded with cosmetic liquid materials. This, in combination with the structure of the container body for pressing to dispense the material in a quantitative manner, allows the cosmeticizing component to be withdrawn, for the use for makeup, in such a way to achieve direct attaching and scraping of the material inside the cap and also allows for supply of the cosmetic liquid material through direct pressing to dispense, achieving convenience of operation and continuous use for makeup. The cosmeticizing device, in the entirety of the structure thereof, indeed achieves the advantages of convenience, practical usefulness, and secured storage.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A cosmeticizing device comprising a hollow container body for receiving a cosmetic liquid material to fill therein, the body having a top end forming a tubular opening to which a valve seat is externally mounted to fix a cosmeticizing component, a closure cap being externally attached for closing and being assembled thereto to constitute a complete package structure of the cosmeticizing device, characterized in that:

the container body has a tubular recess, of which a tubular opening has an outer circumferential forming a coupling threaded surface, the tubular opening fixedly holding the valve seat for receiving the cosmeticizing component to be assembled thereto and having a tubular interior space that receives a cosmetic liquid to fill therein wherein said tubular interior space has a bottom that is closed by a valve disk thereby forming a liquid storage space, the bottom tube seat receiving internally and centrally a plunger bar extending therethrough and threadingly screwed thereto, the plunger bar having a top end rotatably coupled to the valve disk, the bottom tube seat internally receiving an elastic member and a rotary member to assemble thereto, the rotary member having a circumferential surface forming ratchet-tooth faces, which are assembled to be engageable with ratchet teeth of a ratchet bar in an alternately arranged and slightly-shifted manner for controlled transmission therebetween, the bottom tube seat having a distal end receiving a press control member to insert therein for assembling therewith so that the ratchet bar is controllable through pushing for extension/retraction to achieve rotation control of the rotary member, whereby through stepwise rotation achieved with the ratchet teeth of the rotary member, the plunger bar is driven to do simultaneous rotational displacement for driving the valve disk to move into the container body for squeezing and dispensing the liquid material;

the cap has a tubular recess having a tube opening having an inner circumference forming a securing face engageable with the coupling threaded surface of the container body, the tube opening having an inner bottom that fixes an inverted cone shaped scraping member, the cap having an interior bottom space receiving a cosmetic liquid to fill therein;

wherein the container body is inserted, in an inverted manner, into an interior space of the cap for inserted storage constitutes a complete structure of a cosmeticizing device featuring operation safety, allowing for easy material attaching and pressing to dispense the material.

2. The cosmeticizing device according to claim 1, wherein the bottom tube seat has a top end ring surface forming a rough pattern surface.

3. The cosmeticizing device according to claim 1, wherein the tube opening of the cap forms, in a locking bottom section, a step-like configuration for receiving the scraping member to mount and position thereon.

4. The cosmeticizing device according to claim 1, wherein the plunger bar has a bar surface that is recessed to form a positioning groove.

5. The cosmeticizing device according to claim 4, wherein the bar surface of the plunger bar has one positioning groove or a plurality of opposite grooves.

6. The cosmeticizing device according to claim 4, wherein the positioning groove of the bar surface of the plunger bar for fitting with and assembling, in a predetermined direction, to ribs formed in a central hole of the rotary member.

7. The cosmeticizing device according to claim 1, wherein the plunger bar as a bar surface that is in the form of a circular bar or has opposite faces that are planar and parallel.

8. The cosmeticizing device according to claim 1, wherein the ratchet bar is inserted in an orienting-purpose socket sleeve externally enclosing thereof.

9. The cosmeticizing device according to claim 8, wherein the ratchet bar has an outer circumference on which rib grooves are formed for mutual fitting with ribs formed on an inner circumference of the socket sleeve for operation control of synchronous axial sliding.

* * * * *